US006026264A

United States Patent [19]

Wong et al.

[11] Patent Number: 6,026,264

[45] Date of Patent: Feb. 15, 2000

[54] HYBRID SCAVENGELESS DEVELOPMENT SYSTEM

[75] Inventors: Lam F. Wong, Fairport; Gerald T. Lioy; Samuel P. Mordenga, both of Rochester; Zhao-zhi Yu, Webster, all of N.Y.

[73] Assignee: Xerox Corporation, Stamford, Conn.

[21] Appl. No.: 09/292,201

[22] Filed: Apr. 15, 1999

[51] Int. Cl.[7] ..... G03G 15/08

[52] U.S. Cl. ..... 399/266

[58] Field of Search ..... 399/266, 265, 399/279, 281, 285, 290, 291

[56] References Cited

U.S. PATENT DOCUMENTS

| | | | |
|---|---|---|---|
| 2,911,944 | 11/1959 | Hayford et al. . | |
| 4,431,296 | 2/1984 | Haneda et al. | 399/266 |
| 5,359,399 | 10/1994 | Bares et al. | 399/266 |
| 5,734,954 | 3/1998 | Eklund et al. | 399/266 |
| 5,742,884 | 4/1998 | Germain et al. | 399/266 |
| 5,742,885 | 4/1998 | Wayman | 399/266 X |
| 5,758,239 | 5/1998 | Matalevich | 399/266 |

*Primary Examiner*—Sandra Brase
*Attorney, Agent, or Firm*—Lloyd Bean II

[57] ABSTRACT

An apparatus for developing a latent image recorded on an imaging surface, including a housing defining a reservoir storing a supply of developer material including toner. A mag roll loads a toner layer onto a region of said outer surface of said donor member. A donor member, spaced from the imaging surface, moves toner on an outer surface of said donor member to a development zone opposed from the imaging surface. A shield, adjacent to said donor member and said development zone, said shield being electrical biased to generate a toner cloud between said shield and said donor member which said toner cloud releases to the development zone to develop the latent image, in response to the movement of toner on the outer surface of said donor member.

8 Claims, 5 Drawing Sheets

HYBRID SCAVENGELESS DEVELOPMENT SYSTEM

BACKGROUND OF THE INVENTION

This invention relates generally to a development apparatus for ionographic or electrophotographic imaging and printing apparatuses and machines, and more particularly is directed to a cloud generation with an AC field between a shield and a donor roll for cloud development.

Generally, the process of electrophotographic printing includes charging a photoconductive member to a substantially uniform potential so as to sensitize the surface thereof. The charged portion of the photoconductive surface is exposed to a light image from either a scanning laser beam, an LED array or an original document being reproduced. By selectively discharging certain areas on the photoconductor, an electrostatic latent image is recorded on the photoconductive surface. This latent image is subsequently developed by charged toner particles supplied by the development sub-system.

Powder development systems normally fall into two classes: two component, in which the developer material is comprised of magnetic carrier granules having toner particles adhering triboelectrically thereto and single component, which typically uses toner only. Toner particles are attracted to the latent image forming a toner powder image on the photoconductive surface. The toner powder image is subsequently transferred to a copy sheet, and finally, the toner powder image is heated to permanently fuse it to the copy sheet in image configuration.

The operating latitude of a powder xerographic development system is determined to a great degree by the ease with which toner particles are supplied to an electrostatic image. Placing charge on the particles, to enable movement and imagewise development via electric fields, is most often accomplished with triboelectricity. However, all development systems which use triboelectricity to charge toner, whether they be two component (toner and carrier) or mono-component (toner only), have one feature in common: charges are distributed non-uniformly on the surface of the toner. This results in high electrostatic adhesion due to locally high surface charge densities on the particles. Toner adhesion, especially in the development step, is a key factor which limits performance by hindering toner release. As the toner particle size is reduced to enable higher image quality, the charge Q on a triboelectrically charged particle, and thus the removal force ($F=QE$) acting on the particle due to the development electric field E, will drop roughly in proportion to the particle surface area. On the other hand, the electrostatic adhesion forces for tribo-charged toner, which are dominated by charged regions on the particle at or near its points of contact with a surface, do not decrease as rapidly with decreasing size. This so-called "charge patch" effect makes smaller, tribo-charged particles much more difficult to develop and control.

Jumping development systems, in which toner is required to jump a gap to develop the electrostatic latent image, are capable of image quality which can be superior to in-contact systems, such as magnetic brush development. Unfortunately, they are also much more sensitive to toner adhesion. In fact, high toner adhesion has been identified as a major limitation in jumping development. Up to now, mechanical and/or electrical agitation of toner have been used to break these adhesion forces and allow toner to be released into a cloud for jumping development. This approach has had limited success, however. More agitation often releases more toner, but high adhesion due to triboelectric charging still dominates in toner cloud generation and causes unstable development. For full color printing system architectures in which the complete image is formed on the image bearing member, an increase in toner delivery rate produces a highly interactive toner cloud, which disturbs previously developed particles on the latent image. This erases many of the original benefits of jumping development for color xerographic printing for the so-called image-on-image (IOI) architecture. Again, as the toner size is reduced, the above limitations become even more acute due to increased toner adhesion.

Non-interactive development for Image-on-Image (IOI) full color printing systems suffers from serious limitations on development latitude. The primary constraint is that development is strongly dependent on the adhesion of the toner. To make matters worse, toner adhesion often fluctuates significantly with the changing operating conditions of the hardware and the state of the developer materials, causing both long and short time stability problems.

In Hybrid Scavengeless Development (HSD) systems used for non-interactive development in IOI color printers, a series of AC biased wires are closely spaced from a donor roll to detach toner and form a cloud. The HSD system has limitations due to mechanical vibration of the wires (strobing) and wire contamination due to the trapping and attachment of debris (e.g. fibers or toner particles). Both problems result in image noise and visible print defects. Wire motion issues also limit the maximum process width, because longer wires exacerbate the strobing problem.

An object of the present invention is to remove problems associated with toner adhesion and wires employed in such scavengeless development.

SUMMARY OF THE INVENTION

There is provided an apparatus for developing a latent image recorded on an imaging surface, including a housing defining a reservoir storing a supply of developer material including toner. A mag roll loads a toner layer onto a region of said outer surface of said donor member. A donor member, spaced from the imaging surface, moves toner on an outer surface of said donor member to a development zone opposed from the imaging surface. A shield, adjacent to said donor member and said development zone, said shield being electrical biased to generate a toner cloud between said shield and said donor member which said toner cloud releases to the development zone to develop the latent image, in response to the movement of toner on the outer surface of said donor member.

DETAILED DESCRIPTION OF THE FIGURES

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 3 printing machine will be shown hereinafter schematically and their operation described briefly with reference thereto.

Figure 1:
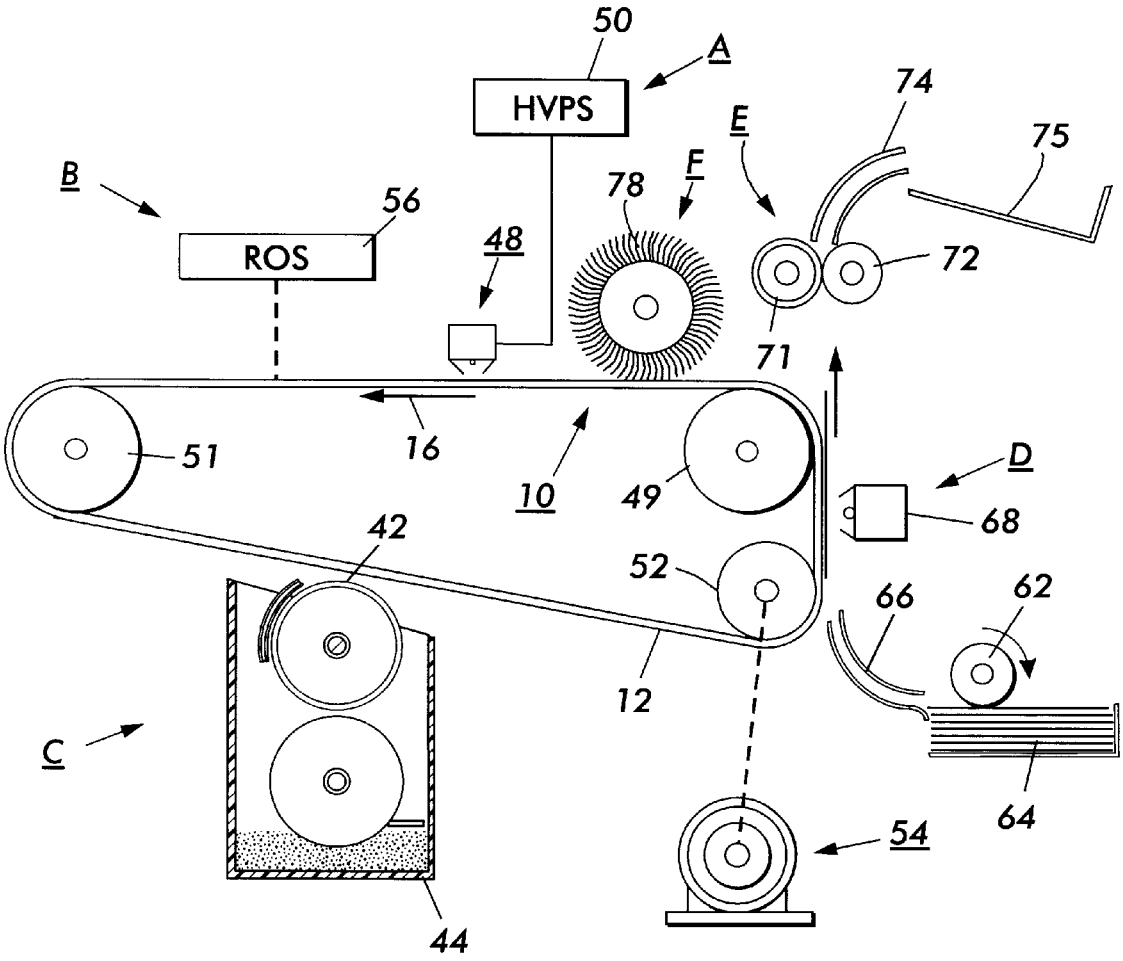
FIG. 1 is a schematic elevational view of an illustrative electrophotographic printing machine incorporating the present invention therein.

Referring initially to FIG. 1, there is shown an illustrative electrophotographic printing machine incorporating the development apparatus of the present invention therein. The printing machine incorporates a photoreceptor 10 in the form of a belt having a photoconductive surface layer 12. Preferably the surface 12 is made from a selenium alloy. The substrate is preferably made from an aluminum alloy or a suitable photosensitive organic compound. The substrate is preferably made from a polyester film such as Mylar (a trademark of Dupont (UK) Ltd.) which has been coated with a thin layer of aluminum alloy which is electrically grounded. The belt is driven by means of motor 54 along a path defined by rollers 49, 51 and 52, the direction of movement being counter-clockwise as viewed and as shown by arrow 16. Initially a portion of the belt 10 passes through a charge station A at which a corona generator 48 charges surface 12 to a relatively high, substantially uniform, potential. A high voltage power supply is coupled to device 48.

Next, the charged portion of photoconductive surface 12 is advanced through exposure station B. At exposure station B, ROS 56 lays out the image in a series of horizontal scan lines with each line having a specified number of pixels per inch. The ROS includes a laser having a rotating polygon mirror block associated therewith. The ROS imagewise exposes the charged photoconductive surface 12.

Figure 3:
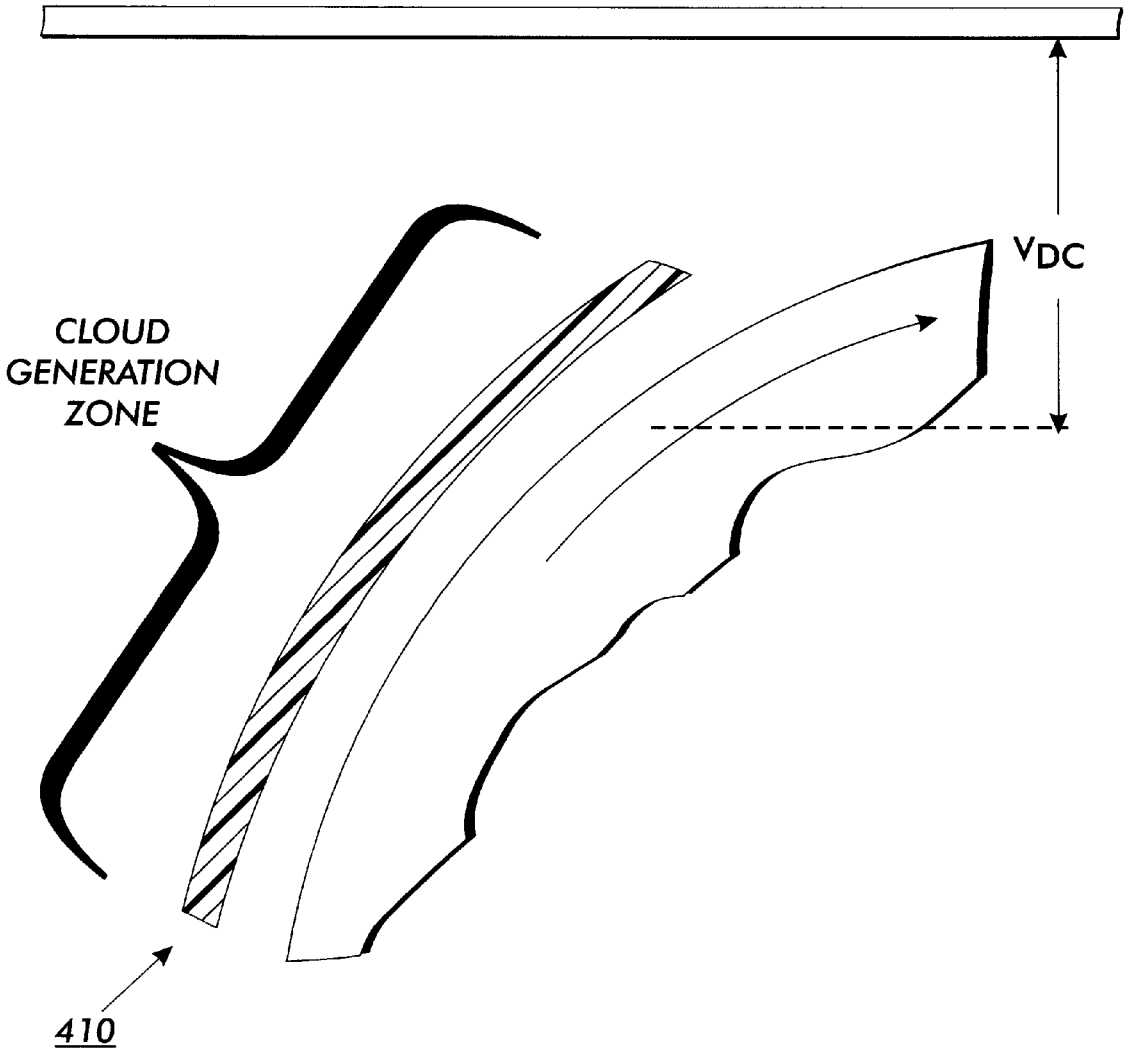
FIG. 3 is a second embodiment of the present invention.

After the electrostatic latent image has been recorded on photoconductive surface 12, belt 10 advances the latent image to development station C as shown in FIG. 3. At development station C, a development system or developer unit 44, develops the latent image recorded on the photoconductive surface. The chamber in the developer housing stores a supply of developer material. The developer material may be a two component developer material consisting primarily of a mixture of toner particles and carrier beads. The developer material may be a custom color consisting of two or more different colored dry powder toners.

Again referring to FIG. 1, after the electrostatic latent image has been developed, belt 10 advances the developed image to transfer station D, at which a copy sheet 64 is advanced by roll 62 and guides 66 into contact with the developed image on belt 10. A corona generator 68 is used to charge the back of the sheet so as to attract the toner image from belt 10 to the sheet. As the belt turns around roller 49, the sheet is stripped therefrom with the toner image thereon.

After transfer, the sheet is advanced by a conveyor (not shown) to fusing station E. Fusing station E includes a heated fuser roller 71 and a back-up roller 72. The sheet passes between fuser roller 71 and back-up roller 72 with the toner powder image contacting fuser roller 71. In this way, the toner powder image is permanently affixed to the sheet. After fusing, the sheet advances through chute 74 to catch tray 75 for subsequent removal from the printing machine by the operator.

After the sheet is separated from photoconductive surface 12 of belt 10, the residual developer material adhering to photoconductive surface 12 is removed therefrom by a rotating fibrous brush 78 at cleaning station F in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 2:
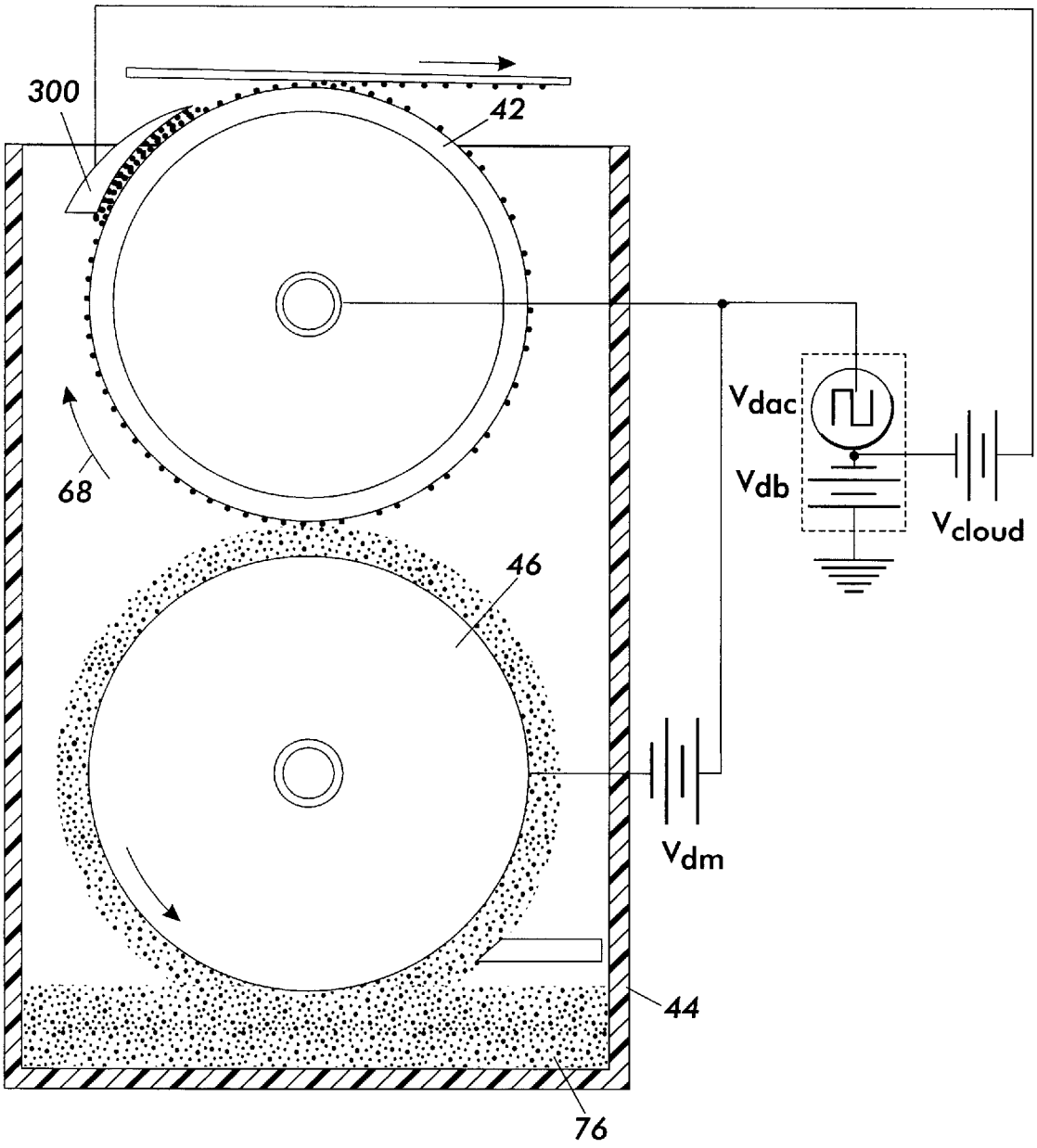
FIG. 2 is a schematic illustration of the development system according to the present invention.

Referring now to FIG. 2, as the donor 42 rotates in the direction of arrow 68, A DC or DC plus AC voltage is applied to the donor roll to electrostatically transfer the desired polarity of toner to the roll. Donor roll 42 is mounted, at least partially, in the chamber of developer housing 44. The chamber in developer housing 44 stores a supply of developer material. Developer material employed is two component conductive development materials.

As successive electrostatic latent images are developed, the toner particles within the chamber 76 are depleted to an undesirable level. A toner dispenser (not shown) stores a supply of toner particles. The toner dispenser is in communication with chamber 76 of housing 44. As the level of toner particles in the chamber is decreased, fresh toner particles are furnished from the toner dispenser.

Donor 42 develops toner via conventional magnetic brush 46 onto the surface of donor 42. This donor roll generally consists of a conductive aluminum core covered with a thin (50 $\mu$m) insulating anodized layer. The mag brush roll is held at an electrical potential difference relative to the donor core to produce the field necessary for toner development on to donor 42.

A cloud generation shield 300 is positioned on top (at the entrance) of the development nip. At 200 microns to 300 microns, the gap between the shield and the donor is smaller than the gap between the donor and photoreceptor which ranges from about 300 microns to 400 microns.

Figure 5:
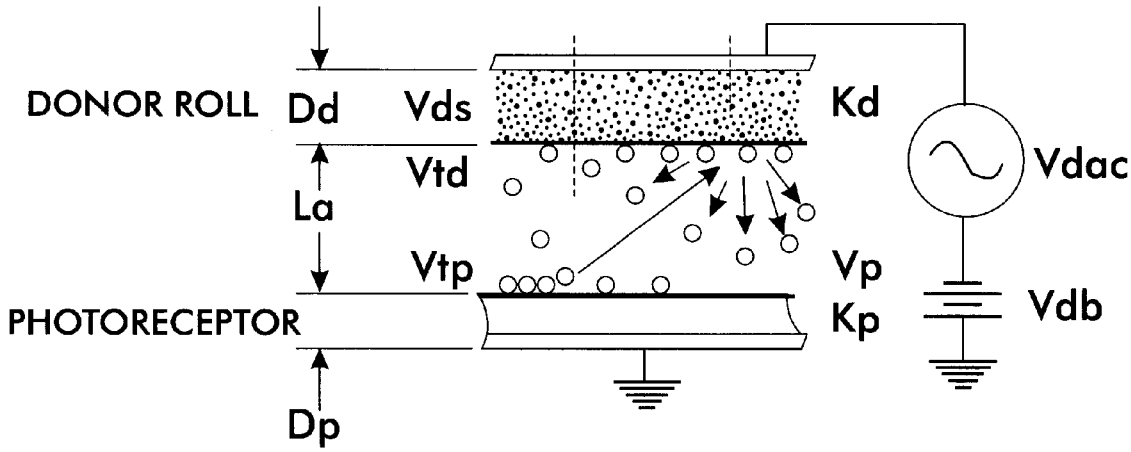
FIG. 5 is a graphical representation of cloud formation between the shield and the donor roll.

The shield 300 acts as a pseudo stationary photoreceptor. Toner particles are jumping back and forth (synchronously) between shield 300 and donor roll 42 to create the toner cloud (as shown in FIG. 5). The "Vcloud" potential, about 200 volts, controls the amount of toners developed on the stationary shield. These toners act as catalytic seeds to start the avalanche effect of hybrid jumping development (HJD).

The potential "Vdac" which is a 1.3 k volt zero to peak square wave at 3.25 k Hz, is used first to generate the toner cloud by jumping back and forth the toners in the pseudo development zone and second to jitter the toner cloud (forward to or backward from the photoreceptor depending on the development field) in the actual development nip.

"Vcloud" controls the intensity of the cloud. The rotational direction of the donor roll causes the toner cloud to rotate in the direction toward the actual development nip. The wider development nip ensures the actual development process is non-scavenging. This process is feasible because the toner particles have already been freed upstream of the nip and adhesion force is no longer a barrier.

The other parts of the development system are typical of HJD. A two component developer is used for donor roll loading, between the magnetic and donor roll nip. The magnetic roll retains the carriers and only toners are allowed to be developed onto the donor roll surface. Single component jumping technology is used thereon.

The potential "Vdm", about 100 volts, applied between the magnetic and donor rolls is used to set the amount of toners to be loaded on the donor roll. The potential "Vdac" which is common between the donor to the shield and the donor to the photoreceptor, is used first to generate the toner cloud by jumping back and forth the toners in the pseudo development zone and second to jitter the toner cloud (forward to or backward from the photoreceptor depending on the development field) in the actual development nip. The potential "Vdb" nominally set at 300 volts is used in general to control the developed image density (toner mass) on the photoreceptor.

Figure 4:
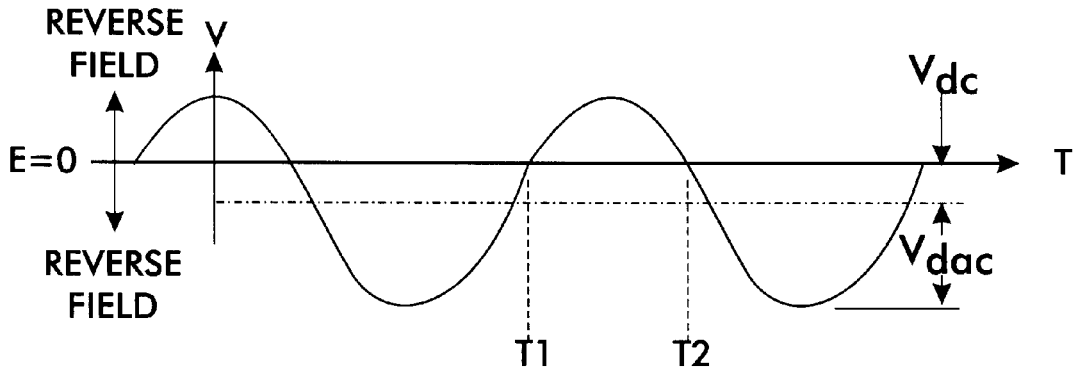
FIGS. 4 illustrates the applied field which generates cloud formation.

FIG. 4 shows the working principle of the conventional HJD system. Toner particles are required to jumping back and forth between the donor and the photoreceptor (or the shield) to liberate the toner supply on the surface of the donor roll. The adhesion force between the majority of the toner particles and the donor roll surface is too strong to assure an adequate supply of toners with a one-way jumping system.

Figure 6:
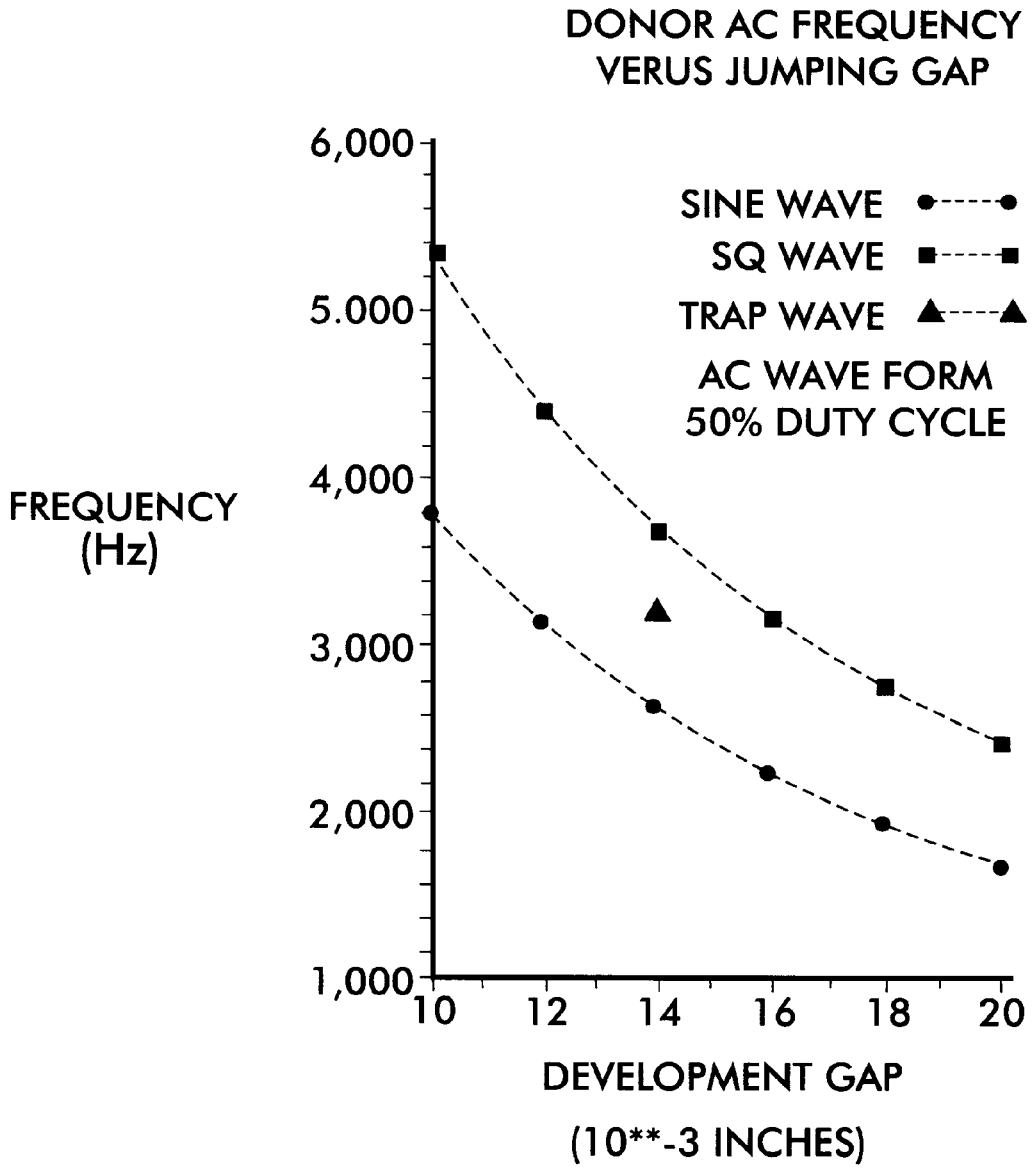
FIG. 6 illustrates the relationship between shield gap and synchronous frequency.

For a given design of jumping gap and AC jumping voltage potential, there exists a resonance (or synchronous) frequency that incurs the best mobility of toner particles—a condition where the system scavenges the most. FIG. 6 plots the resonance frequency as a function of the jumping gap at a fixed AC potential. At the resonance frequency, the mechanical motion of an average toner particle coincides with the electrical AC jumping wave form. That is the toner particle will make exactly one round trip motion from the donor to the photoreceptor (or the shield) and back to the donor within one period of the AC wave cycle. At higher frequencies, the mechanical motion of the toner particle can not keep up with the AC wave, and the round trip motion becomes a partial trip motion. The development process becomes much less scavenging. At higher yet frequencies, the motion of the toner particle becomes jittery and the development process approaches scavengeless. Given a fixed frequency, increasing the jumping development gap gives the same scenario. The gap between the donor and the shield is used to determine the resonance frequency for the most interactive scavenging pre-development toner cloud generation. The motion of the toner particle in the gap between the donor and the photoreceptor, which is larger than the gap between the donor and the shield, becomes jittery and the development process approaches scavengeless.

The drawbacks of the wide gap scavengeless HJD development process are very low development efficiency and unstable selective development. The adhesion force of the majority toners on donor can not be overcome by electrostatic means; the incorporation of the stationary development shield just upstream of the development zone is used to mobilize the toner particles to compensate for drawbacks.

FIG. 3 is a second embodiment of the shield of present invention. The AC field between the lower part of the shield 410 and the donor roll generates a toner cloud, which is brought to the nip by the air flow due to the donor roll rotation. The DC field (Development or cleaning field without AC component) between the donor roll and the photoreceptor will control the cloud development.

Applicants have found significant cloud generated at the development nip under a 2.5 kVp-p & 3 KHz Ac across a 15 mil gap in the cloud generation zone; a good development on the photoreceptor was also obtained.

Inrecapulation, there has been provided an apparatus for developing a latent image recorded on an imaging surface, including a housing defining a reservoir storing a supply of developer material including toner. A mag roll loads a toner layer onto a region of said outer surface of said donor member. A donor member, spaced from the imaging surface, moves toner on an outer surface of said donor member to a development zone opposed from the imaging surface. A shield, adjacent to said donor member and said development zone, said shield being electrical biased to generate a toner cloud between said shield and said donor member which said toner cloud releases to the development zone to develop the latent image, in response to the movement of toner on the outer surface of said donor member.

Other embodiments and modifications of the present invention may occur to those skilled in the art subsequent to a review of the information presented herein; these embodiments and modifications, as well as equivalents thereof, are also included within the scope of this invention.

What is claimed is:

1. An apparatus for developing a latent image recorded on an imaging surface, comprising:

a housing defining a reservoir storing a supply of developer material comprising toner;

a donor member, spaced from the imaging surface, for transporting toner on an outer surface of said donor member to a development zone opposed from the imaging surface;

means for loading a toner layer onto a region of said outer surface of said donor member; and a shield, adjacent to said donor member and said development zone, said shield being electrical biased to generate a toner cloud between said shield and said donor member which moves to the development zone to develop the latent image, said shield includes a conductive inner portion facing said donor member having a first bias potential and a conductive outer portion having a second bias potential.

2. The apparatus of claim 1, wherein said shield is spaced between 200 microns and 300 microns from said donor member.

3. The apparatus of claim 1, wherein said shield has an electrical bias between 100 and 300 volts.

4. The apparatus of claim 3, wherein electrical bias has a frequency between 2250 and 4250 hertz.

5. An electrophotographic printing machine having an apparatus for developing a latent image recorded on an imaging surface, comprising:

a housing defining a reservoir storing a supply of developer material comprising toner;

a donor member, spaced from the imaging surface, for transporting toner on an outer surface of said donor member to a development zone opposed from the imaging surface;

means for loading a toner layer onto a region of said outer surface of said donor member; and a shield, adjacent to said donor member and said development zone, said shield being electrical biased to generate a toner cloud between said shield and said donor member which moves to the development zone to develop the latent image, said shield includes a conductive inner portion facing said donor member having a first bias potential and a conductive outer portion having a second bias potential.

6. The apparatus of claim 5, wherein said shield is spaced between 200 microns and 300 microns from said donor member.

7. The apparatus of claim 6, wherein electrical bias has a frequency between 2250 and 4250 hertz.

8. The apparatus of claim 5, wherein said shield has an electrical bias between 100 and 300 volts.

* * * * *